United States Patent [19]

Inoko et al.

[11] Patent Number: 4,758,301

[45] Date of Patent: Jul. 19, 1988

[54] HANDLE ADHERING DEVICE

[75] Inventors: Kenji Inoko, Shiga; Kaneko Yutaka, Tokyo, both of Japan

[73] Assignee: Tetra Pak International Aktiebolag, Lund, Sweden

[21] Appl. No.: 919,543

[22] Filed: Oct. 14, 1986

Related U.S. Application Data

[63] Continuation of Ser. No. 771,211, Aug. 30, 1985, abandoned.

[30] Foreign Application Priority Data

Sep. 4, 1984 [JP] Japan ..... 59-186250

[51] Int. Cl.[4] ..... B26D 5/32

[52] U.S. Cl. ..... 156/361; 156/486; 156/489; 156/521; 156/566

[58] Field of Search ..... 156/510, 516–521, 156/522, 552, 361, 353; 83/152, 154, 129, 209, 269, 273, 276, 277

[56] References Cited

U.S. PATENT DOCUMENTS

| | | | |
|---|---|---|---|
| 2,217,325 | 10/1940 | Von Hofe | 156/489 X |
| 2,483,458 | 10/1949 | Fischer et al. | 156/521 |
| 2,990,081 | 6/1961 | DeNeui et al. | 156/521 X |
| 3,306,802 | 2/1967 | Wilcox et al. | 156/521 X |
| 3,634,173 | 1/1972 | Hoppner | 156/521 |
| 3,832,829 | 9/1974 | Stout | 53/590 |
| 3,834,970 | 9/1974 | Mitsuoko et al. | 156/521 X |
| 3,886,026 | 5/1975 | Kienel | 53/590 X |
| 4,415,399 | 11/1983 | Geisinger | 156/486 |
| 4,422,357 | 12/1983 | Larsen | 83/276 X |

*Primary Examiner*—David Simmons

*Attorney, Agent, or Firm*—Koda and Androlia

[57] ABSTRACT

A handle adhering device wherein an adhesive is applied to one surface of a belt-like article, auxiliary pieces are adhered to the adhesive surface with predetermined spaces therebetween, the belt-like article is wound onto a reel-like shape, is cut into predetermined lengths to form a handle member in which adhesive surfaces are exposed at both ends, and the adhesive surfaces of the handle member are adhered to both side surfaces of an article. In this device the non-adhesive surface of the belt-like members are sucked onto an outer peripheral surface of a rotating drum and are paid out by predetermined lengths respectively, cut by a cutter as the drum rotates to form the handle members and lifted off of the rotation drum by adhesive arms passing through recesses in the drum to adhere the adhesive surfaces at both ends of the handle member.

3 Claims, 7 Drawing Sheets

HANDLE ADHERING DEVICE

This is a continuation of application Ser. No. 771,211, filed Aug. 30, 1985, now abandoned.

BACKGROUND OF THE INVENTION

1. Field of the Invention

The present invention relates to a device for efficiently adhering or attaching a simple handle to an article.

2. Prior Art

Such devices exist in the prior art and, as shown in FIG. 2, include a belt-like article having one surface to which an adhesive is applied and the belt-like article is cut to a predetermined length to form handle members 2. Another auxiliary member 3 is attached to a portion except for both ends of each handle member to form a holding part. Adhesive surfaces at both ends are attached to both side surfaces of an article A to construct a handle. Conventionally, a method has been employed to attach the handle to the article wherein a belt-like article wound into a reel-like shape is drawn out and cut into a predetermined length to form the handle member, of which both ends are nipped by holding claws and are compressively attached to the side surfaces of the articles A.

In the conventional handle adhering method, drawing-out of the belt-like article, holding, cutting and adhering are performed at the same position, so that high speed processing is impossible.

SUMMARY OF THE INVENTION

Accordingly, it is a general object of the present invention to provide a handle adhering device capable of efficiently performing drawing-out of a belt-like article, and cutting and adhering the belt-like article to form a handle.

In keeping with the principles of the present invention, a handle adhering device is provided which includes a rotating drum for drawing out a belt-like article wound into a reel-like shape. In particular, the rotating drum is provided at the outer peripheral surface of the belt-like article. The rotating drum then rotates at a predetermined angle to draw out a predetermined length of the belt-like article. On the outer peripheral surface of the rotating drum, a cutter cuts the belt-like article, and the handle member is sucked onto and held on the outer peripheral surface of the rotating drum. Of course, the rotation of the rotating drum is interconnected with a draw-out roller for drawing out the belt-like article.

The outer peripheral surface of the rotating drum is further provided with recesses which are recessed from the central portion or radially inner side. Adhesion arms passing through the recesses are provided for hitching and taking out the handle member sucked onto and held on the recess. An article A is positioned just under the rotating drum, so that the adhesion arms compressively attach adhesive surfaces provided at both ends of the handle member to the side surfaces of the article.

An end of the belt-like article wound into a roll is sucked onto the outer peripheral surface of the rotating drum, and the drum is temporarily stopped after rotation of at a predetermined angle, e.g. a quarter turn corresponding to the length of the handle member, so that a predetermined length of the belt-like article is drawn. During the stop, the drawn-out belt-like article is cut by a cutter, and the cut article or piece is sucked onto the outer peripheral surface of the rotating drum as the handle member. Then, similarly to the above case, the rotating drum is rotated to a predetermined angle, e.g. a quarter turn, so that the belt-like article to be the next handle member is drawn out. During this operation, the handle member which has already been cut and sucked onto the lower portion of the outer peripheral surface of the rotating drum is entering the adhering step. Namely, while the rotating drum stops, the adhesion arms operate to move downwardly through the recesses of the rotating drum, so that the handle member at the lower position is caught or hitched by the adhesion arms and separated from the rotating drum. In this operation, the handle member is adhered to the article A positioned just under the rotating drum. Then, the rotating drum rotates further to repeat the same operation, and a new article is supplied to the position under the rotating drum. As described above, according to the invention, drawing out of the belt-like member, cutting and adhering of the handle member proceed simultaneously at the various predetermined positions on the rotating drum.

BRIEF DESCRIPTION OF THE DRAWINGS

The accompanying drawings illustrate an embodiment of a handle adhering device of the invention, wherein.

DETAILED DESCRIPTION OF THE INVENTION

Hereinafter, embodiments of a handle adhering device according to the invention will be described with reference to the accompanying drawings.

Figure 1:
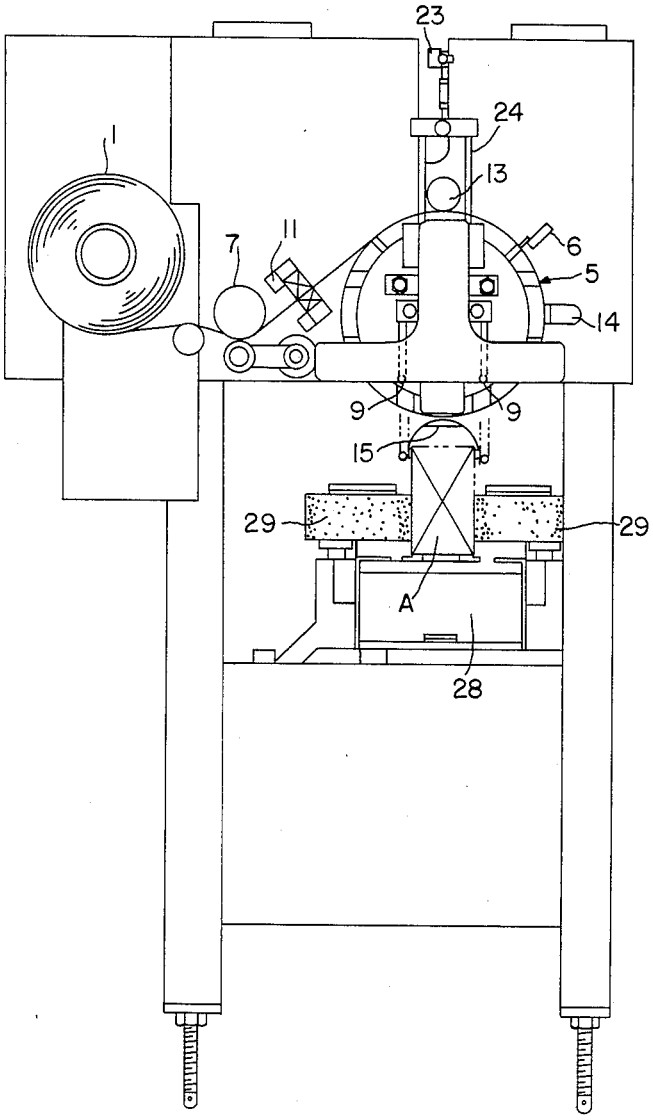
FIG. 1 is an elevational view of the whole invention.
Figure 2:
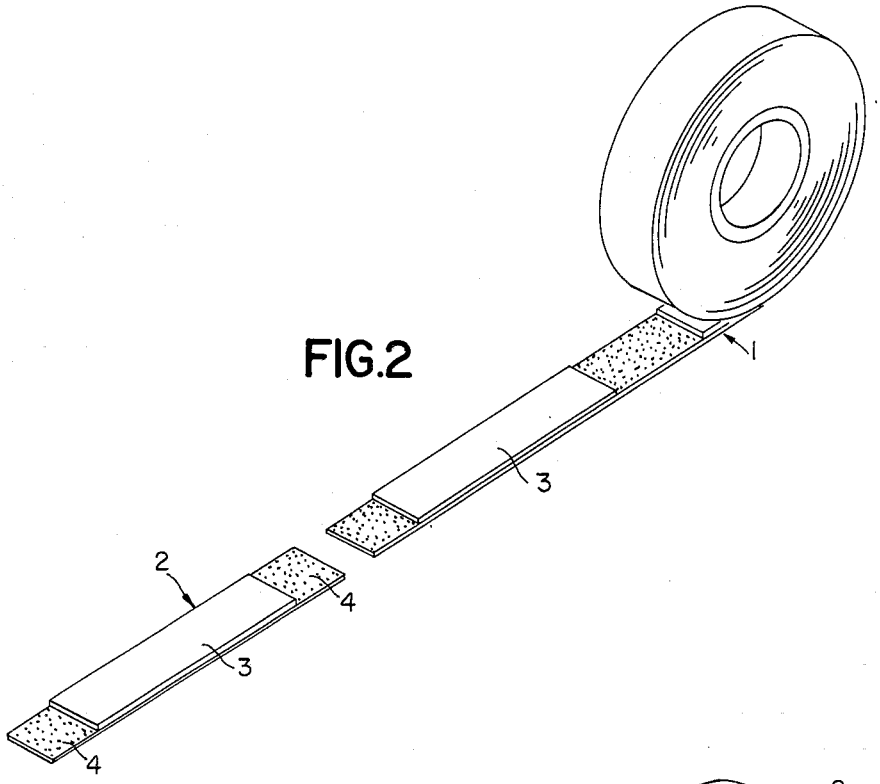
FIG. 2 is a perspective view of a belt-like member to be cut into a handle member.
Figure 3:
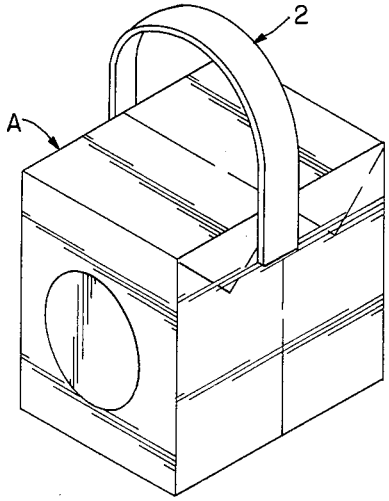
FIG. 3 is a perspective view illustrating an example of a condition in which a handle is adhered to an article.
Figure 5:
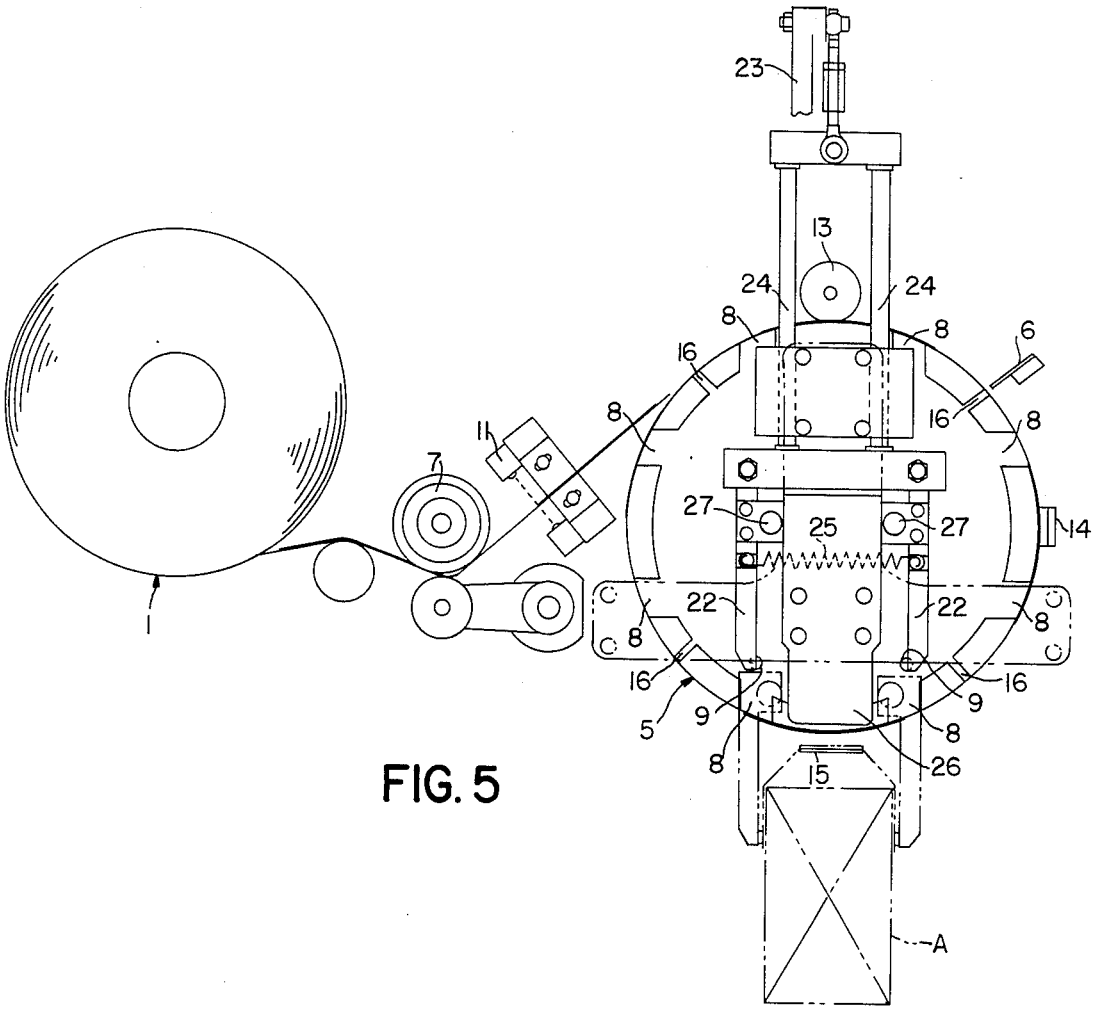
FIG. 5 is an enlarged elevational view of only a rotating drum part.
Figure 7:
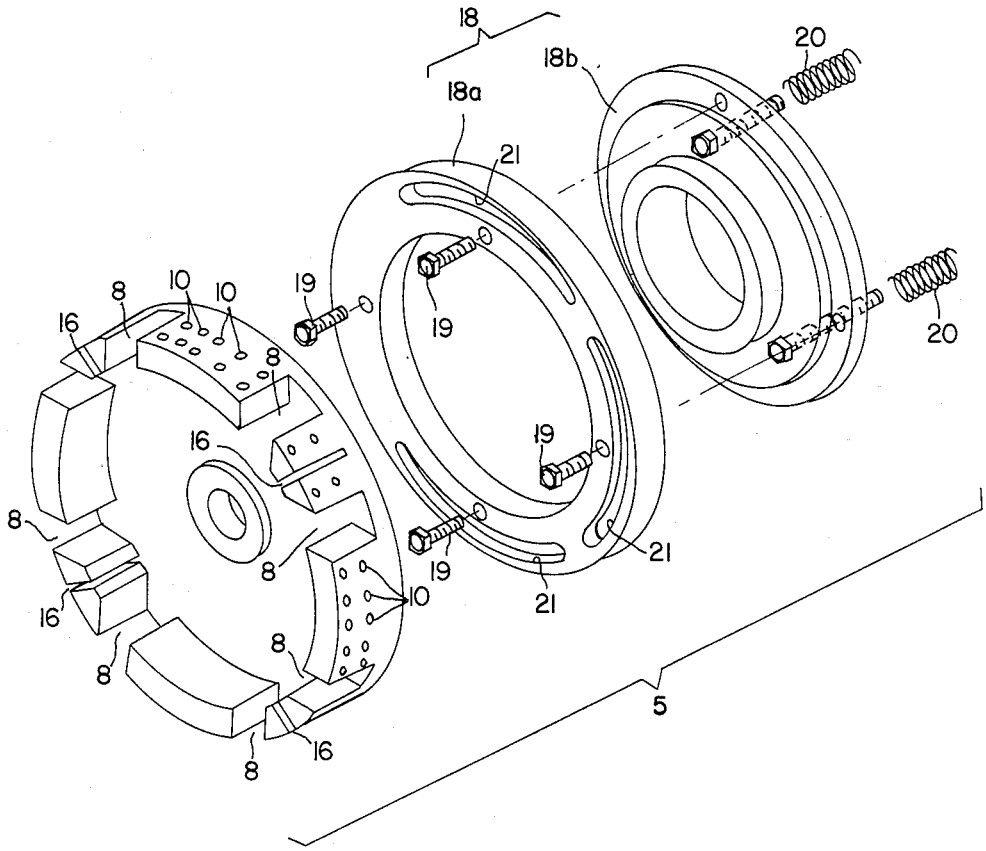
FIG. 7 is a perspective view of the rotating drum in a disassembled condition.

As shown in FIG. 2, a belt-like article 1 to be cut to form a handle member 2 is wound into a roll and is supplied to a rotating drum 5 through a feed roller 7 as shown in FIGS. 1 and 5. The rotating drum 5 is, as shown in FIG. 7, a cup-like form and is provided at its outer peripheral surface with many suction ports 10 for sucking up the non-adhesive surface of the belt-like article 1.

The rotating drum 5, onto which the belt-like member is sucked, is adapted to intermittently rotate at a predetermined angle, e.g. a quarter turn in the illustrated embodiment, so as to successively draw out a predetermined length of the belt-like article 1 sucked onto the rotating drum 5. Namely, the outer circumferential length of the rotating drum 5 is substantially four times as large as the length of the one handle member 2, so that a cutter can cut a predetermined length of the handle member 2 after the intermittent quarter turn rotation.

Of course, the pitch is not necessarily accurate between one auxiliary piece and a following auxiliary piece adhering to the belt-like article 1 because the rotating drum 5 contracts in accordance with a change in the temperature. Therefore, there is fear that desired handle members cannot be obtained because errors in the length will accumulate if constant lengths are successively slowly drawn out.

Therefore, in the embodiment, the length of the arc in a predetermined angle of the rotating drum is determined to be slightly longer than the length of the handle member 2. A photoelectric sensor 11 is provided to detect the auxiliary piece adhering to the belt-like article so that the feed roller 7 may stop before the stopping of the rotating drum 5 to cause a slight slippage between the rotating drum 5 and the belt-like article.

As described above, the drawn out length of the belt-like article to be cut is based on the position of the auxiliary member piece 3 and a slight slippage occurs between the belt-like member and the rotating drum 5, so that the handle members 2 cut at the desired position can always be obtained. Further, the belt-like members sucked onto the outer peripheral surface of the rotating drum 5 can be prevented from becoming loose so that the cutter 6 can advantageously perform reliable cutting.

On the radially outside positions of the rotating drum 5, as shown in FIG. 5, a pinch roller 13 is diposed before the cutter 6 and a pressure piece 14 is disposed after the cutter 6, so that both may press the belt-like article to prevent harmful movement during the operation of the cutter 6.

The handle member 2 cut by the cutter 6 is transferred to the lower position of the rotating drum 5 while being sucked onto the outer peripheral surface thereof. And, at the lower position of the rotating drum, a pair of adhesion arms 9 are adapted to vertically move through recesses 8 which are formed by portions of the outer peripheral surface of the rotating drum 5 recessed from the radially inner side. The arms 9 are designed to separate the handle member from the outer peripheral surface of the rotating drum 5 and attach the separated handle member to an article A placed just under the drum.

Figure 8A:
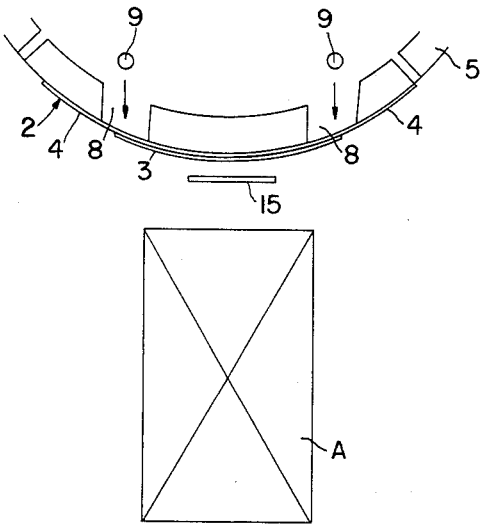
FIGS. 8(*a*), 8(*b*) and 8(*c*) are schematic elevational views illustrating the adhering process of the handle member.
Figure 8B:
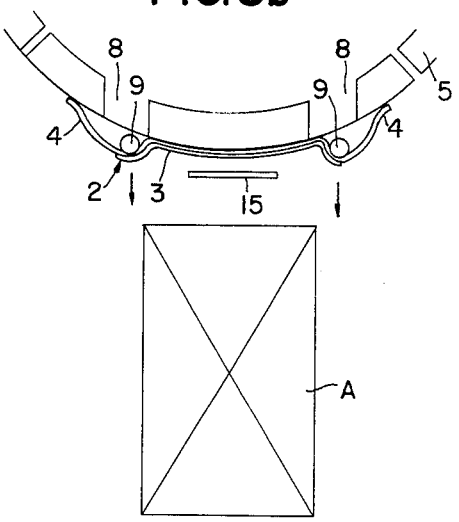
Figure 8C:
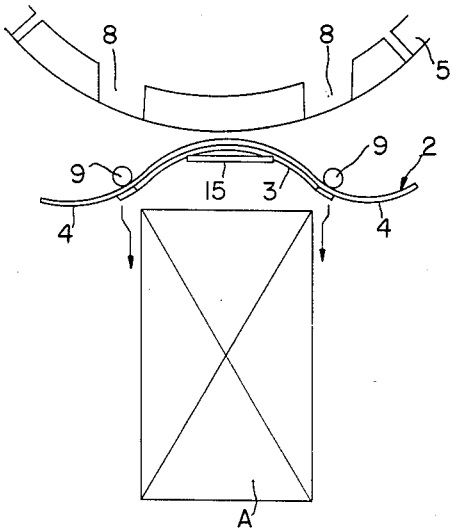

That is, as shown in FIG. 8(*a*), the adhesion arms 9 start lowering while the rotating drum 5 stops. As shown in FIG. 8(*b*), when the arms pass through the recesses 8 of the rotating drum, they catch both ends of the handle members 2 sucked thereon to separate the handle member 2 from the rotating drum as shown in FIG. 8(*c*); the arms 9 further lower so that both ends of the handle member 2 compressively adhere to side surfaces of the articles A.

Between a pair of adhesion arms 9, a support piece 15 is fixedly disposed under the rotating drum 5 so that it may support substantially the middle portion of the handle member 2 separated from the rotating drum 5 for preventing dropping thereof and ensuring correct adhesion of the adhesive surfaces at both ends of the handle member 2 to the predetermined positions on the side surfaces of the article A.

The rotating drum 5 is, as shown in FIG. 5, of a cup-like form and is provided at the outer peripheral surface with many suction ports 10 as well as a necessary number of said recesses 8 through which a pair of adhesion arms 9 extend radially outwardly from the central portion. That is, in the illustrated embodiment, since the rotating drum 5 rotates quarter by quarter turn, the recesses are provided at a total of eight portions, and in other words, respectively, two portions in each of four directions.

Further, in order to facilitate the cutting of the belt-like member sucked onto the rotating drum 5, the drum 5 is provided at the outer peripheral surface with four circumferentially equally spaced cut grooves 16 into which the cutter 6 can enter.

Figure 6:
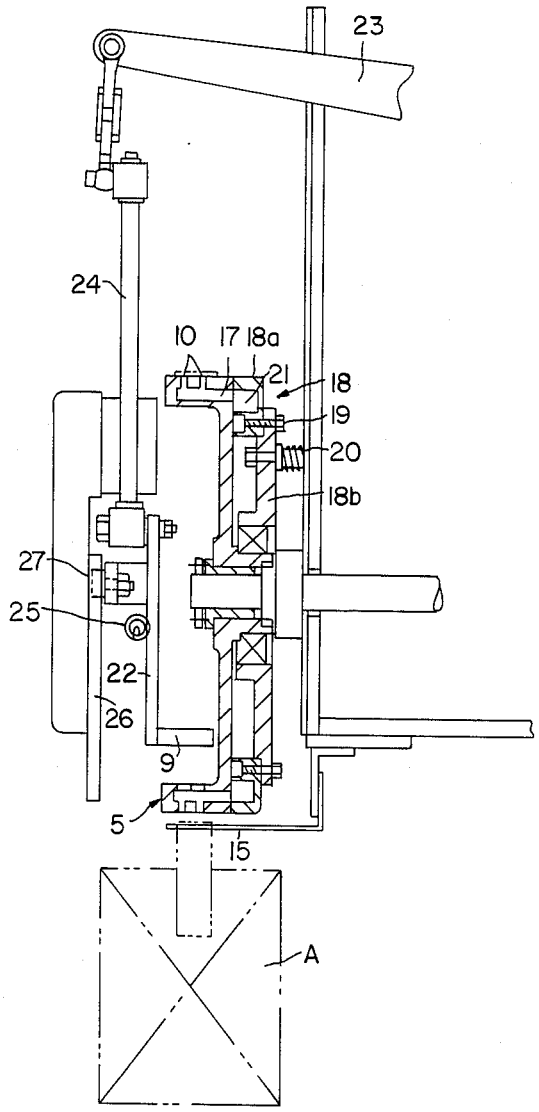
FIG. 6 is a side view of FIG. 5 with a certain part cut away.

As shown in FIG. 6, the suction ports 10 provided on the outer peripheral surface of the cup-like rotating drum 5 are connected to other air ports 17 which open at the rear surface thereof, so that the suction ports 10 in the rotating drum 5 may produce a vacuum condition and have a suction function. As seen from FIG. 7, a stationary plate 18 consisting of a ring-like member 18*a* and a disk-member 18*b* fixed together by screws 19 is disposed at the rear surface of the cup-like rotating drum 5. The plate 18 is forced by springs 20 to closely contact the rear surface of the rotating drum 5. Arc-shaped concave grooves 21 are provided in predetermined ranges of the ring-like member 18*a* which are ranges necessary for generating the suction force and face the air ports 17 in the rotating drum 5. A vacuum generator (not shown) is connected to the concave grooves 21.

Next, the adhesion arms 9 for separating the handle member 2 sucked onto the rotating drum 5 and attaching it to the article A will be described. The adhesion arms 9 are supported by a pair of support rods 22 which are supported by connecting rods 24 connected to an arm 23. The arm 23 is interconnected with the operation of the rotating drum 5 so as to move vertically for driving the adhesion arms 9. A pair of support rods 22 are forced inwardly by a spring 25 so as to pull each other. A cam plate 26 is disposed between the support rods 22. The support rods 22 are provided with guide rollers 27 which are adapted to roll on the cam plate 26 so as to achieve the intended movement of the adhesion arms 9. Namely, the lower half of the cam plate 26 which controls the movement of the adhesion arms 9 has narrow width so that the adhesion arms 9 may be pulled toward each other. The adhesion arms 9 are adapted to move, as indicated by an arrow in FIG. 8(*c*), for compressively attaching both ends of the handle member to the article A.

Figure 4:
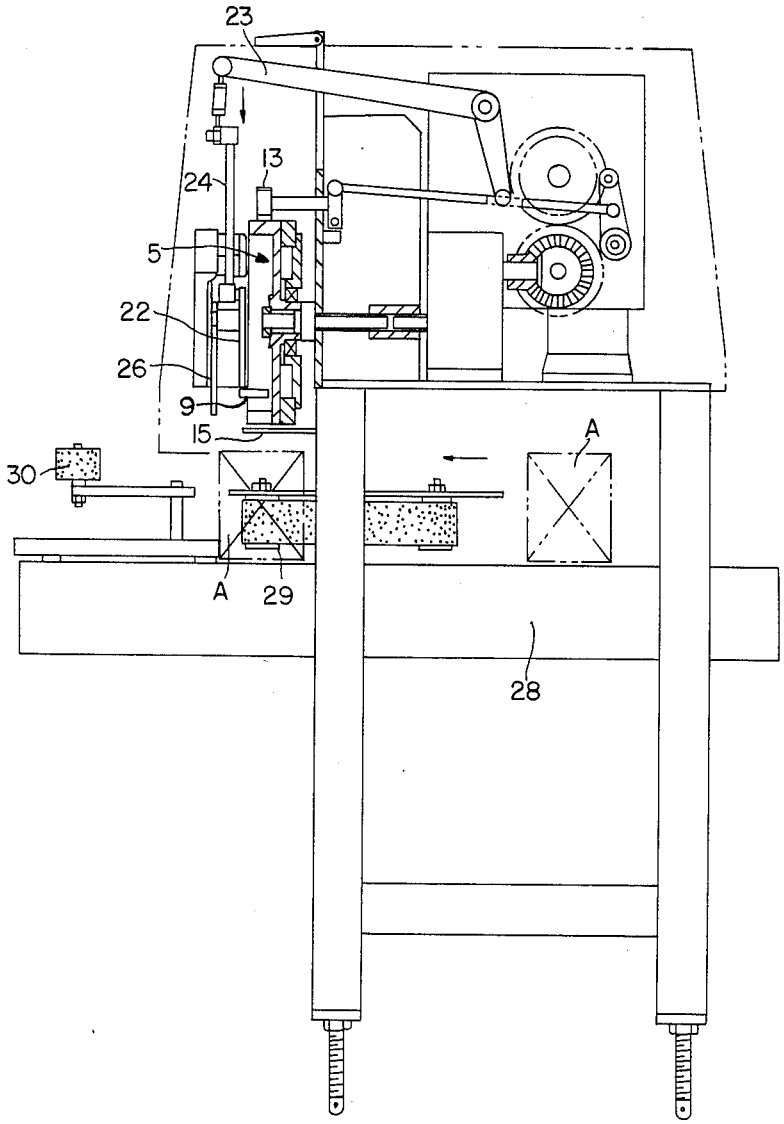
FIG. 4 is a side view of the whole device with a certain part cut away.

As shown in FIGS. 1 and 4, a conveyance conveyor 28 is disposed under the rotating drum 5 for supplying the article A to the intended portion just under the drum 5.

A pair of vertical conveyors 29 are disposed transversely of both sides of the conveyance conveyor 28. The operation of the vertical conveyors 29 is interconnected with the operation of the rotating drum 5, so that the articles are individually supplied to the intended position just under the rotating drum 5 and stopped thereat.

As shown in FIG. 4, pressure rollers 30 are provided downstream of the vertical conveyors 29. These are adapted to re-press the adhesive surface portion 4 of the handle member 2 which have already been attached by the adhesion arms 9 just under the rotating drum, which effectively ensures the adhesion of the handle member 2 to the article A.

According to the handle adhering device of the invention, the drawing-out of the belt-like article to be the handle, the cutting and the attaching to the article A can simultaneously proceed at various predetermined different positions on the rotating drum, which eliminates useless waiting time. Therefore, successive operations can be performed extremely efficiently, and operational speed can be increased compared with conventional devices. Further, the device itself can advantageously be relatively simplified.

It should be apparent to those skilled in the art that the above described embodiments are merely illustrative of but a few of the many possible embodiments which can made without departing from the spirit and scope of the present invention.

We claim:

1. A handle adhering device comprising a means for applying an adhesive to one surface of a belt-like member, a means for adhering auxiliary pieces to the adhesive surface with predetermined spaces therebetween wherein the adhesive surface is exposed, a means for winding the belt-like member into a reel-like shape, a means for cutting the belt-like member into predetermined lengths at the predetermined spaces to form a handle member in which adhesive surfaces are exposed at both ends, and a means for adhering the adhesive surfaces of the handle members to both side surfaces of an article, which is further characterized in that a feed roller is provided for feeding said belt-like member toward said rotating drum, a non-adhesive surface of the belt-like member is sucked onto an outer peripheral surface of a rotating drum and are drawn out in predetermined lengths respectively by rotating the rotating drum a predetermined amount which is slightly longer than a length of said handle member, a position sensor is provided adjacent the belt-like member for sensing said auxiliary pieces and for stopping the feed rollers before said rotating drum stops so that a slight slippage occurs between the rotating drum and the belt-like member to accurately position the belt-like member for cutting, said means for cutting belt-like member is a cutter which operable to cut the belt-like member on the outer peripheral surface of the rotating drum to form the handle member, the rotating drum is open at one side and cup-like in shape, the rotating drum is provided with a plurality of pairs of recesses equally spaced about the outer peripheral surface of the rotating drum, the means for adhering the adhesive surfaces of the handle members to both side surfaces of said article comprises a single pair of adhesion arms provided within the circumference of the rotating drum and adapted to sequentially pass through one of said plurality of pairs of said recesses so that it picks up and takes out the handle members sucked onto the outer peripheral surface of the rotating drum, the article is positioned at a position just under the drum, and the pair of adhesion arms are operable to compressibly adhere the adhesive surfaces at both ends of the handle member to a side surface of the article.

2. A handle adhering device according to claim 1, further comprising a pinch roller and a pressure piece for pressing the belt-like member onto the outer peripheral surface of said drum when said belt-like member is cut by said cutter, said pinch roller and said pressure piece being respectively provided in front of said cutter and behind said cutter.

3. A handle adhering device according to claim 1, wherein said pair of adhesion arms are supported by a pair of support rods, a cam plate is provided between said support rods, a guide roller is provided between each support arm and a cam surface of said cam plate and a spring is provided between said support arms for biasing said guide rollers into engagement with said cam surface.

* * * * *